US006768070B2

(12) United States Patent
Lewison et al.

(10) Patent No.: US 6,768,070 B2
(45) Date of Patent: Jul. 27, 2004

(54) SWITCHES

(75) Inventors: John Lewison, Northants (GB); James Draycott, Northants (GB); Paul Tebbutt, Northants (GB)

(73) Assignee: IN2TEC Ltd. (GB)

( * ) Notice: Subject to any disclaimer, the term of this patent is extended or adjusted under 35 U.S.C. 154(b) by 0 days.

(21) Appl. No.: 10/463,874

(22) Filed: Jun. 18, 2003

(65) Prior Publication Data

US 2004/0011633 A1 Jan. 22, 2004

(30) Foreign Application Priority Data

Jun. 20, 2002 (GB) ..... 0214310

(51) Int. Cl.[7] ..... H01H 9/00

(52) U.S. Cl. ..... 200/296; 200/302.1; 200/302.2; 200/512

(58) Field of Search ..... 200/511–517, 294–296, 200/302.1, 302.2, 341

(56) References Cited

U.S. PATENT DOCUMENTS 4,352,968 A * 10/1982 Pounds ..... 200/302.2
4,378,478 A 3/1983 Deeg
4,421,966 A * 12/1983 Pounds ..... 200/309
5,089,671 A * 2/1992 Ranetkins ..... 200/5 A
5,260,532 A 11/1993 Tinder et al.
6,067,005 A * 5/2000 DeVolpi ..... 338/47
6,382,809 B1 * 5/2002 Ou-Yang ..... 362/102
6,501,036 B2 * 12/2002 Rochon et al. ..... 200/302.2
6,626,473 B1 * 9/2003 Klein et al. ..... 292/347

* cited by examiner

*Primary Examiner*—Michael A. Friedhofer
(74) *Attorney, Agent, or Firm*—Nixon & Vanderhye PC

(57) ABSTRACT

A switch (1) comprises a elastomeric body (2) which includes a recess (3) formed therein for receiving a printed circuit board (4). The external periphery of the PCB (4) engages in an internal groove (6) so as to form a closed switch cavity (7) between the PCB an one end of the body, said one end of the body including a resiliently deformable portion (11) which is movable to bring a movable contact (13) into engagement with fixed contact (8,9) carried on the PCB (4) so as to establish an electrical connection therebetween. The body (2) includes an external groove (42) to mount the switch on a panel (40), and a seal is provided in the external groove (42) to prevent the ingress of water and the like to the recess (3) of the body (2).

11 Claims, 3 Drawing Sheets

SWITCHES

BACKGROUND OF THE INVENTION

This invention relates to switches, and in the preferred embodiment provides two improved switches of the type having an elastomeric body which cooperates with components mounted on a printed circuit board (PCB) to provide a switch.

Switches of the general type comprising an elastomeric body and a printed circuit board which cooperate to form a switch are well known and are frequently used for controlling electrical connections in relatively hostile environments, for example in wet conditions, or areas of high humidity, or in relatively dirty environments such as certain industrial sites. The switches proposed heretofore all suffer from certain disadvantages, and in particular are either complex and time consuming to assemble or mount or provide inadequate sealing of the electric contacts against the ingress of moisture and dirt from the surrounding environment.

SUMMARY OF THE INVENTION

The preferred switches of the present invention offer improved sealing against the ingress of moisture or dirt into the area of the electrical contacts and interior of the equipment from the mounting hole for the switch, and offer a number of other advantages as compared with the prior art.

According to a first aspect of the present invention a switch comprises an elastomeric body shaped to define a recess for receiving a printed circuit board (PCB); a PCB mounted to the body in the recess to define with the body a closed switch cavity; fixed electrical contacts provided on the PCB within the switch cavity, and at least one movable contact provided in the switch cavity, a portion of the body being resiliently deformable to bring the movable contact into engagement with the fixed contacts to establish an electrical connection therebetween.

The fact the PCB is mounted to the body to define therewith a closed switch cavity substantially simplifies construction of the switch and provides a means for excluding moisture and dirt from the area of the electrical contacts.

In preferred embodiments of the invention the body recess defines a groove in which the periphery of the PCB is mounted to provide the required closing of the switch cavity. If desired, the interface between the groove and the PCB may be sealed with an appropriate sealant. If desired the layer of sealant may be provided in the body recess on the side of the PCB remote from the switch cavity to ensure a hermetic seal between the PCB and the body.

The fixed contacts may be electrically connected to flex tails to provide electrical connections to the contacts. In the alternative, the contacts may be connected to pins or a socket mounted on the PCB to cooperate respectively with a socket, wires or the pins of a connector device.

In one embodiment of the invention the movable contact is mounted on the deformable portion of the body. In alternative embodiments a contact disc may be provided within the switch cavity to be acted upon by the deformable portion of the body. The disc may be configured to provide normally open, normally closed, or momentary make connections between the fixed contacts.

If desired, the body may be formed of a transparent or translucent material and one or more indicator or illumination devices may be provided on the PCB in the switch cavity to provide illumination to the switch and/or contact status information.

The preferred embodiments of the invention may be mounted on a panel from the front thereof with little or no access being required to the switch from the rear of the panel to effect. Typically, switches may be secured to the panel either using an elastomeric deformable skirt on the body or using mounting clips provided for the purpose on the body or on the PCB.

By appropriate choice of material for the body the switch cannot only be made robust and relatively inexpensive, but it can also readily be customised to the particular application for which it is intended. In particular, custom legends may be printed directly onto the body and/or a metal key faceplate may be secured to the body.

Depending upon the particular applications for which the switch is intended the PCB may be a conventional rigid PCB or may be a flex circuit or ITO.

In one preferred embodiment of the invention the switch is configured as a single push momentary action switch. In an alternative embodiment of the invention the switch is embodied as a rocker switch. The rocker switch may include contacts under only one end portion of the switch (thereby simulating a simple on-off rocker switch), or may incorporate contacts under two spaced apart end portions of the switch (thereby simulating a changeover switch), or may incorporate contacts under two end portions of the switch and under a centre portion to provide a range of relatively complex switch simulations.

BRIEF DESCRIPTION OF THE DRAWINGS

The invention will be better understood from the following description of a preferred embodiment thereof, given by way of example only, reference being had to the accompanying drawings wherein.

DETAILED DESCRIPTION

Figure 1:
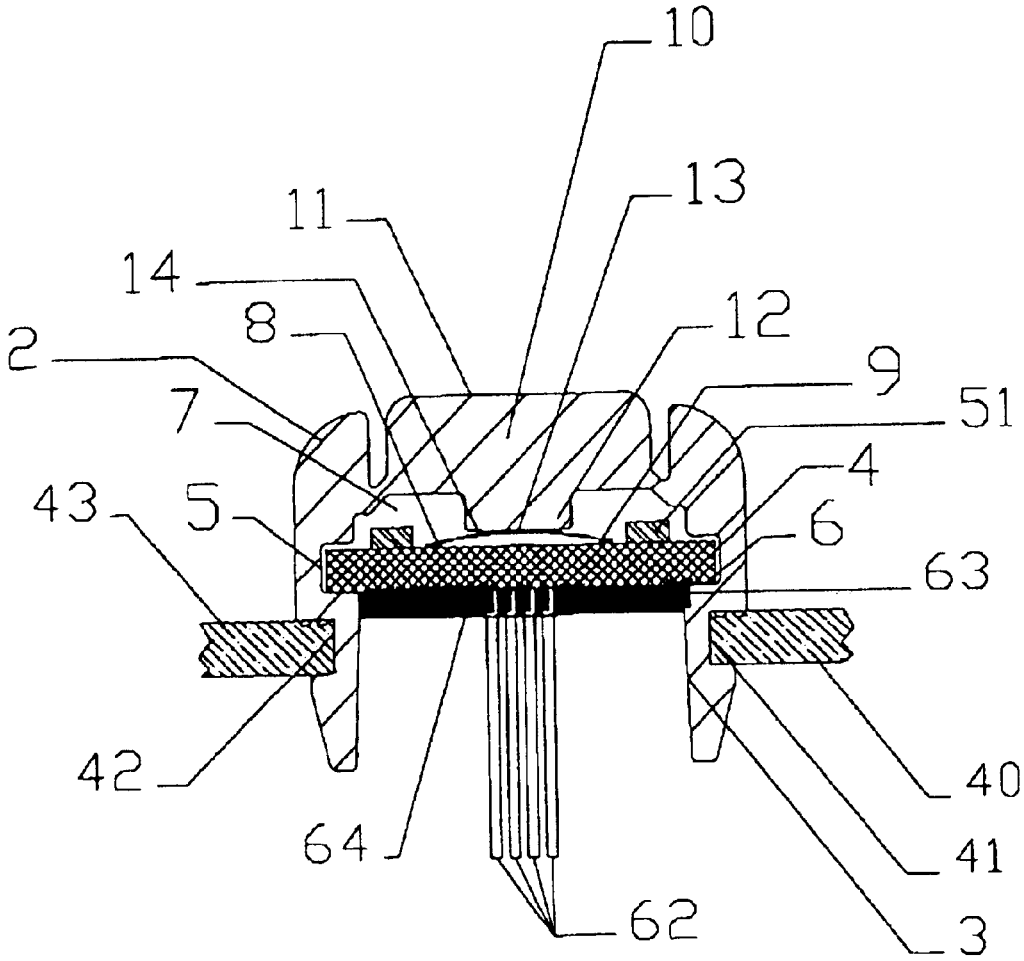
FIG. 1 is a schematic cross-sectional view through a first embodiment of the invention.

Referring firstly to FIG. 1 there is illustrated schematically and in transverse cross-section a switch 1 in accordance with the first embodiment of the invention. Switch 1 comprises a body 2 which defines a recess 3 in which is mounted a PCB 4. The periphery 5 of the PCB is received in a continuous groove 6 provided in the body 2 so that the PCB defines with the body a substantially closed switch cavity 7. Fixed contacts 8,9 are provided on the PCB in the switch cavity.

The body 2 is formed of a suitable material and is so shaped that a central portion 10 thereof forms a protruding "button" 11. The arrangement is such that the button 11 may be depressed by finger pressure, such depression being accommodated by elastic deformation of the body. When finger pressure is removed elastic recovery will tend to return the button 11 to the illustrated position.

A boss 12 is formed on the underside of the button and either carries a movable contact 13 or acts on a movable contact 14 which is retained in position adjacent fixed contact 8 or contacts 8,9. Accordingly, by manual depression of the button the contacts 8,9 may be connected to each other momentarily, or may be changed from a closed state to an open state or vice versa, depending on the detailed design of the switch interior.

Electrical connections to the contacts 8,9 may be provided by way of a custom design flex tail 12, optionally provided with a connector and the end thereof remote from the PCB 4. Alternatively, a socket or pin base 63 may be provided on the PCB and electrically connected via appropriate tracks on the PCB to the contacts 8,9 or wires 62. Preferably, the socket or pin holder is a standard socket or standard pin profile to enable the switch to be used in association with a standard plug or socket respectively.

Optionally, a layer of appropriate sealant 64 (for example a rubber/epoxy fill) may be provided on the side of the PCB remote from the switch cavity 7 to provide a complete hermetic seal between the PCB and the body so as to ensure substantially complete sealing of the switch cavity 7.

Alternative embodiments of the invention are illustrated in FIGS. 2–5. In these switches multiple switching contacts are provided to provide multiple switching action. In the case of the switch illustrated in FIGS. 2 and 4 the switch provides three separate buttons 15,16,17 which can conveniently be used to produce e.g. "up", "stop" and "down" movements. In the case of FIGS. 3 and 5 the illustrated switch is in the form of a rocker switch.

Figure 2:
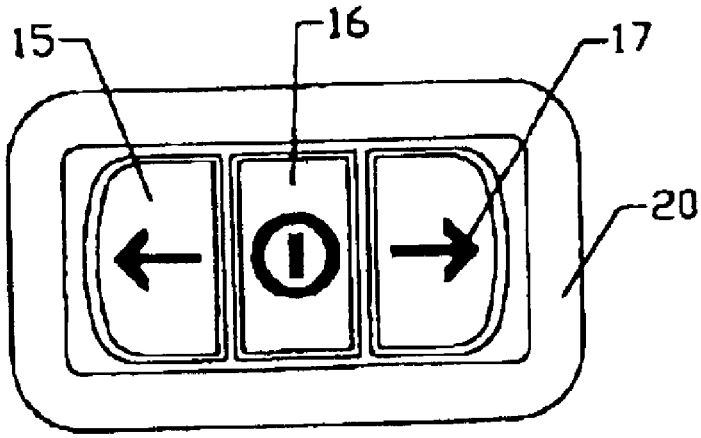
FIG. 2 illustrates in plan view a second embodiment of the invention.
Figure 3A:
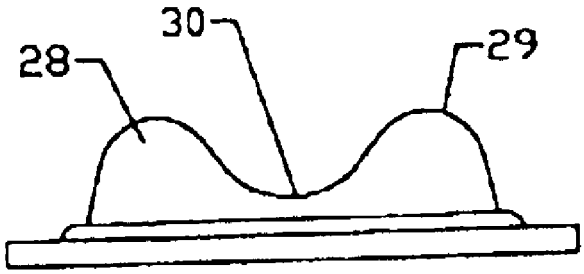
FIGS. 3A, 3B and 3C illustrate respectively alternative switch profiles for the embodiment of FIG. 2.
Figure 3B:
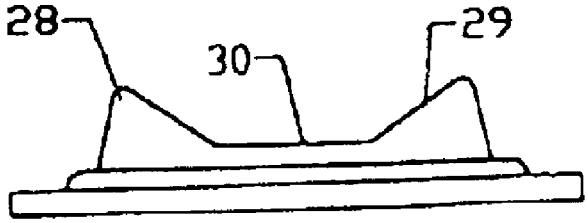
Figure 3C:
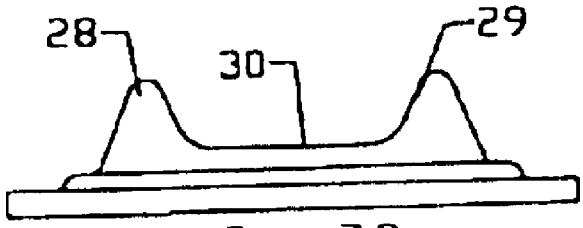
Figure 4:
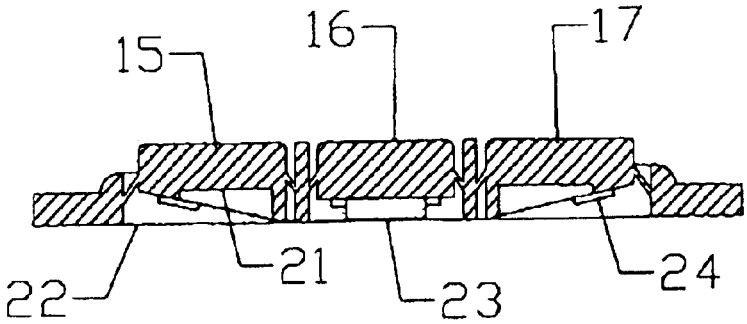
FIG. 4 is a cross-sectional view of the body of the switch of FIG. 2, prior to mounting of the PCB.
Figure 5A:
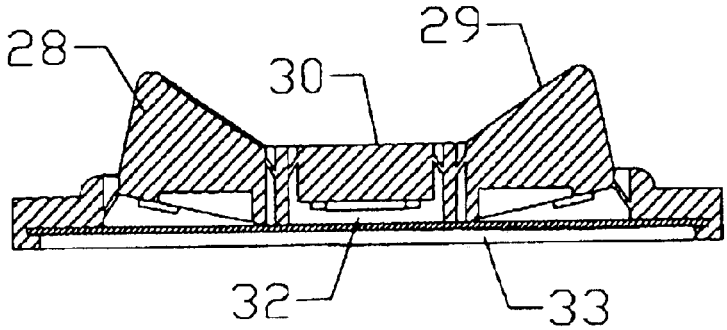
FIGS. 5A, 5B and 5C illustrate various possible arrangements utilising a body simulating a conventional double throw rocker switch.
Figure 5B:
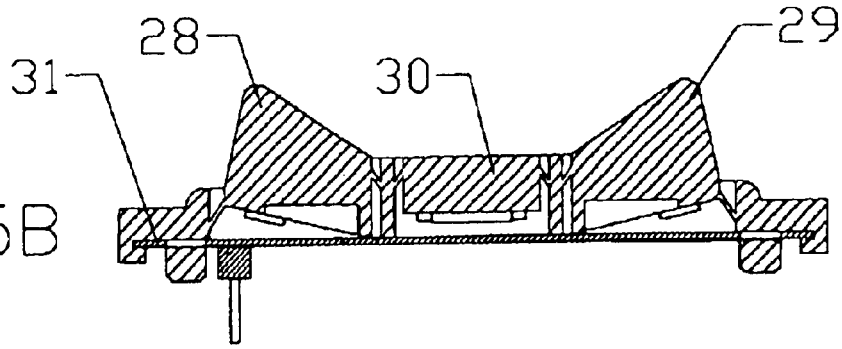
Figure 5C:
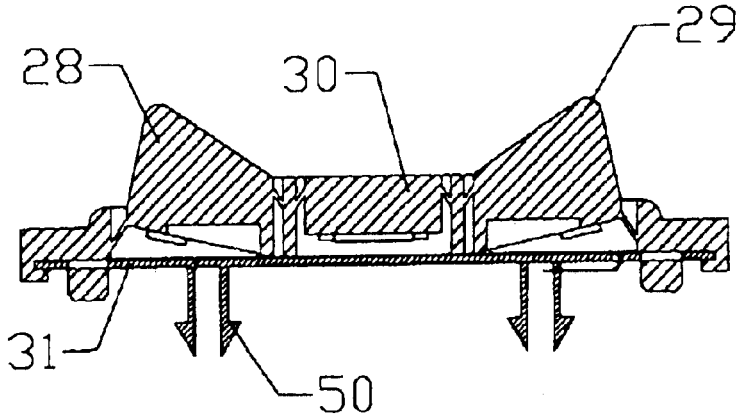

Considering firstly FIGS. 2 and 4 the illustrated switch comprises an elastomeric body 20 defining a recess 21 made up of separate zones 22,23 and 24. The body 22 includes thinned portions to define the three separate movable buttons 15,16,17. As illustrated in FIG. 2, the buttons may be identified with appropriate legends printed on the material of the body. The switches illustrated in FIGS. 3A, 3B and 3C and 5A, 5B and 5C have bodies which are in many ways similar to those of the switch of FIGS. 2 and 4. In this case, however, the form of the moulding is such that the outermost buttons 28,29 extend in a ramp-like configuration from the central button 30 so as to simulate the appearance of a rocket switch.

In the case of all the embodiments of FIGS. 2–5 the body 20 is used in association with a PCB 31 which cooperates with the body 20 to form a substantially closed switch cavity 32. The sealing between the PCB and the body 30 may be effected by providing a groove in the body 30 to receive a peripheral portion of the PCB and/or may be effected using suitable sealants or adhesives. In either event, a volume of sealants 33 may be provided on the side of the PCB remote from the switch cavity to ensure a substantially complete hermetic seal.

As previously, at least one and preferably several contacts are associated with each button so that depressing the button manually causes a contact mounted on the underside of the button or a separate contact mounted between the button and the PCB to engage the or some of the fixed contacts provided on the PCB.

It will be noted that the switches illustrated in FIGS. 3A,B,C and 5A,B,C provide a simple and robust switch which simulates the appearance of a conventional rocker switch.

Referring now back to FIG. 1 it will be noted that the illustrated switch can readily be mounted on a panel 40 in which a suitable hole 41 is provided. A groove 42 is provided in the exterior surface of the body to receive the material of the panel so that the switch may be mounted thereon from the front side 43 only thereof. Alternatively, the design may be such that minimal access to the rear of the panel may be desirable or necessary to mount the switch but no loose components or fixings need be offered up to the switch from the rear of the panel in order to hold it in position.

The switches of FIGS. 2–5 may be mounted in a similar way to the switch of FIG. 1, if the bodies thereof are appropriately profiled with the necessary groove for receiving material of a panel. In the alternative, as illustrated in FIG. 5C special mounting prongs 50 may be secured to the PCB to facilitate ready mounting thereof on a panel provided with holes designed to cooperate with the mountings.

The switches illustrated above offer a number of significant advantages over and above those of a similar general type found in the prior art. In particular, custom markings may readily be provided by printing directly onto the body material. By making the material of the body transparent or translucent illumination of the switch or lighting indicative of the status of the switch may readily be provided by mounting appropriate LED's 51 on the PCB. The mounting arrangements illustrated permit easy mounting from the front only of a panel. The designs provide a high degree of isolation between the contacts located in the switch cavity and the surrounding environment, thereby reducing possible malfunctions due to the ingress of dirt or moisture. The switches illustrated in FIGS. 2–5 offer the further advantage of being low profile and being of particularly aesthetically pleasing form. In all cases, by appropriate choice of body material the body may be able to dissipate static charge.

The switches of the preferred embodiment of the invention may readily be adapted to a modular form allowing custom arrays of switch units to be created. Although the embodiments of the invention illustrated above make use of a rigid PCB it is to be understood that under certain circumstances a flex circuit or ITO may serve to mount the fixed contact and close the switch cavity.

What is claimed is:

1. A switch comprising an elastomeric body having a recess formed therein for receiving a printed circuit board (PCB), the PCB mounted to the body in the recess to define with the body a closed internal switch cavity, fixed electrical contacts provided on the PCB within the switch cavity, and at least one movable contact provided in the switch cavity, wherein a portion of the body is resiliently deformable to bring the movable contact into engagement with the fixed contacts so as to establish an electrical connection therebetween, wherein the body includes an internal groove formed in and extending around side walls of the recess, a periphery of the PCB engaging in said groove so as to close said switch cavity, wherein the body includes an external a groove which extends around an outer periphery of the body, an inner periphery of a mounting hole formed in a panel being engageable in said external groove so as to mount the switch on said panel.

2. A switch according to claim 1, further including seal means associated with the internal groove for sealing the body to the PCB.

3. A switch according to claim 1, wherein the external groove delimits an elastomeric deformable skirt formed on the body on an open end thereof remote from the resiliently deformable portion, said skirt engaging, in use, in the mounting hole in order to mount the switch on the panel.

4. A switch according to claim 1, further including seal means associated with the external groove which, in use, engage with the inner periphery of the mounting hole so as to provide a seal between the body and the panel.

5. A switch according to claim 4, wherein the seal means is a labyrinth seal.

6. A switch according to claim 1, wherein the internal groove is formed in the body axially between the external groove and the resiliently deformable portion of the body.

7. A switch according to claim 6, wherein the PCB is wider than an inner diameter of the external groove, such that, upon mounting of the switch on the panel, the inner periphery of the mounting hole overlaps the periphery of the PCB, thereby firmly retaining the PCB in the body.

8. A switch according to claim 6, wherein the PCB overlaps said external groove.

9. A switch according to claim 1, wherein the fixed contacts are electrically connected to flex tails which extend out of an open end of the body opposite said resiliently deformable portion of said body.

10. A switch according to claim 1, further including mounting clips provided on at least one of the body and the PCB for mounting the switch on a panel.

11. A switch according to claim 1, wherein the switch is a front mounting switch.

* * * * *